US012799699B2

(12) United States Patent
Jung et al.

(10) Patent No.: US 12,799,699 B2
(45) Date of Patent: Nov. 17, 2026

(54) DRILLING APPARATUS FOR CREATING A BOREHOLE

(71) Applicant: HERRENKNECHT AG, Schwanau (DE)

(72) Inventors: Boris Jung, Shutterwald (DE); Manfred Kaiser, Friesenheim-Oberschopfheim (DE); Thorsten Reich, Schwanau (DE)

(73) Assignee: Herrenknecht AG, Schwanau (DE)

( * ) Notice: Subject to any disclaimer, the term of this patent is extended or adjusted under 35 U.S.C. 154(b) by 52 days.

(21) Appl. No.: 18/028,501

(22) PCT Filed: Sep. 28, 2021

(86) PCT No.: PCT/EP2021/076712

§ 371 (c)(1),
(2) Date: Mar. 24, 2023

(87) PCT Pub. No.: WO2022/069499

PCT Pub. Date: Apr. 7, 2022

(65) Prior Publication Data

US 2023/0332367 A1 Oct. 19, 2023

(30) Foreign Application Priority Data

Sep. 30, 2020 (DE) ..... 10 2020 125 629.9

(51) Int. Cl.
*E02D 27/52* (2006.01)
*E02D 7/28* (2006.01)
*E02D 17/16* (2006.01)

(52) U.S. Cl.
CPC ..... *E02D 7/28* (2013.01); *E02D 17/16* (2013.01)

(58) Field of Classification Search
CPC . E02D 17/16; E02D 7/28; E02D 27/52; E02F 5/006; E21B 7/208; E21B 7/20; E21D 1/06; F02F 5/00
See application file for complete search history.

(56) References Cited

U.S. PATENT DOCUMENTS 1,039,809 A * 10/1912 Rogers ..... E21D 9/1093 175/96
1,219,419 A * 3/1917 App ..... E21D 9/1093 299/62

(Continued)

FOREIGN PATENT DOCUMENTS

DE 2734185 A1 2/1979
DE 3219362 C1 4/1983

(Continued)

*Primary Examiner* — Edwin J Toledo-Duran
(74) *Attorney, Agent, or Firm* — Mark Rogers

(57) ABSTRACT

The invention relates to a drilling device for establishing a drill hole in the ground, having a main body (11), having a drilling tool which is disposed on one end of the main body (11), having a drive for the drilling tool that is provided on the main body, having a bracing device which is conceived for bracing the drilling device (10) in a cylindrical hollow body (20) and which has at least one bracing plane (31, 32) having at least two bracing elements which by way of a first end are disposed on the main body (11) and which on the second end of said bracing elements have at least one bracing member, wherein the at least one bracing member of the bracing element by means of at least one drive is able to be moved from a first position to a second position. It is provided according to the invention here that the bracing member by way of at least one element on the internal wall of the hollow body provides a form-fitting connection between the main body and the hollow body.

14 Claims, 7 Drawing Sheets

(56) References Cited

U.S. PATENT DOCUMENTS 1,284,398 A * 11/1918 McKinlay ..... E21D 9/1093 175/11
2,925,258 A * 2/1960 Robbins ..... E21D 9/1093 299/33
3,379,264 A * 4/1968 Cox ..... E21D 9/112 175/102
3,383,138 A * 5/1968 Delisio ..... E21D 9/1093 175/94
3,386,520 A * 6/1968 Lawrence ..... E21D 9/113 166/120
3,554,603 A * 1/1971 Kampf-Emden et al. ..... E21D 9/1093 175/99
3,584,918 A * 6/1971 Gaglione ..... E21B 7/00 74/606 R
3,604,754 A * 9/1971 Kampf-Emden ..... E21D 3/00 299/56
3,640,573 A * 2/1972 Safar ..... F16C 19/545 299/60
3,653,716 A * 4/1972 Hattrup ..... E21D 9/104 175/96
3,703,314 A * 11/1972 Hamilton ..... E21D 9/1093 299/10
3,965,995 A * 6/1976 Sugden ..... E21D 1/03 175/57
4,122,683 A * 10/1978 Follert ..... E21D 9/0879 405/142
4,189,186 A * 2/1980 Snyder ..... E21D 9/1093 173/150
4,312,541 A * 1/1982 Spurgeon ..... E21D 9/01 175/94
4,371,211 A * 2/1983 Snyder ..... E21D 9/112 299/11
4,396,072 A * 8/1983 Hurtz ..... E21B 19/08 175/57
4,494,617 A * 1/1985 Snyder ..... E21D 1/06 175/94
4,548,282 A * 10/1985 Hurtz ..... E21B 17/1014 175/267
4,637,657 A * 1/1987 Snyder ..... E21D 9/112 299/33
4,646,853 A * 3/1987 Sugden ..... E21D 1/06 175/57
4,818,025 A * 4/1989 Lundal ..... E21D 9/106 405/148
5,125,719 A * 6/1992 Snyder ..... E21D 9/1093 384/101
5,228,752 A * 7/1993 Hartwig ..... E21D 9/1093 405/138
5,924,222 A * 7/1999 Stoetzer ..... E02F 3/205 37/189
6,270,163 B1 * 8/2001 Mullet ..... E21C 25/58 299/57
6,447,036 B1 * 9/2002 White ..... B66C 1/427 294/201
6,857,488 B2 * 2/2005 Pastor ..... E21D 9/112 175/373
6,857,706 B2 * 2/2005 Hames ..... E21C 25/16 299/1.1
7,192,093 B2 * 3/2007 Jackson ..... E21C 29/14 299/10
7,617,558 B2 * 11/2009 Boe ..... B08B 9/049 15/104.061
7,658,244 B2 * 2/2010 Mohrmann ..... E21B 4/006 175/371
7,695,071 B2 * 4/2010 Jackson ..... E21C 25/16 299/1.05
8,534,765 B2 * 9/2013 Burger ..... E21D 1/06 299/31
9,222,233 B2 * 12/2015 Peters ..... E02D 7/16

FOREIGN PATENT DOCUMENTS

WO 2010139380 A1 12/2010
WO 2013081455 A1 6/2013
WO 2015131984 A1 9/2015

* cited by examiner

DRILLING APPARATUS FOR CREATING A BOREHOLE

The invention relates to a drilling device for establishing a drill hole in the ground, having a main body, having a drilling tool which is disposed on one end of the main body, having a drive for the drilling tool that is provided on the main body, having a bracing device which is conceived for bracing the drilling device in a cylindrical hollow body and which has at least one bracing plane having at least two bracing elements which by way of a first end are disposed on the main body and which on the second end of said bracing elements have at least one bracing member, wherein the at least one bracing member of the bracing element by means of at least one drive is able to be moved from a first position to a second position. The invention furthermore relates to a system for establishing a drill hole in the ground, having an above-mentioned drilling device in conjunction with a cylindrical hollow body.

When erecting buildings in which the foundations thereof are supported in or on ground, respectively, which is situated underwater, for example, these foundations are produced in various ways, wherein the use of so-called monopiles, thus single piles, has become the norm in the case of integral foundations. An alternative thereto is the so-called jacket, this being a pyramid-shaped construction, or tripods which have in each case a plurality of foundation points. These buildings are wind power installations or bridge constructions, for example.

According to the prior art, in the case of monopiles so-called jack-up rigs are provided for example on site, the working plane of said jack-up rigs being provided with a swing gear. The pile is clamped in this swing gear, deflected from the horizontal to the vertical, and by opening the clamps released onto the seabed. The pile is subsequently driven into the ground by means of a pile driver.

A drilling device which, proceeding from a working platform, is lowered into an upright foundation pile is known from WO 2010/139380 A1. The drilling device has an arm, a drilling roller by way of which the ground situated in or below the drilling pile, respectively, is excavated being disposed on the end of said arm, the drilling pile subsequently being lowered into the cavity.

Drilling devices which are similar to those described at the outset are likewise known from WO 2013/081455 A1 and from WO 2015/131984 A1. The drilling device has a main body which is composed of two parts which are mutually displaceable by means of a hydraulic cylinder. An arm is disposed on the lower main body, a drill head being situated on the end of said arm. The rock/ground situated in or below the pile, respectively, is released and conveyed away by this arm. The housing is braced in relation to the foundation pile. Provided to this end are pivotable arms on the ends of which clamping elements are provided. In order for the drilling device to be braced in the pile, the arms by way of hydraulic cylinders are pivoted outward until the clamping elements come to engage with the pile. The bracing installations are in each case disposed on the upper and on the lower end of the outer housing part of the drilling device. It has been demonstrated that, for one thing, the bracing installations are worthy of improvement.

It is the object of the invention to improve the connection between a hollow body, such as a foundation pile or a housing/machine tube of a drilling device, and the drilling device.

In terms of the drilling device the object according to the invention and according to a first solution is achieved in that the bracing member by way of at least one element on the internal wall of the hollow body provides a form-fitting connection between the main body and the hollow body.

A releasable yet stable and particularly precise connection can be achieved in a simple manner as a result.

A further teaching of the invention provides that the hollow body is a pile for founding a building, a casing, or a liner.

It is advantageous here that the main body is removable from the hollow body. As a result, it becomes possible for the hollow body to be drilled into the ground in a simple manner while the drilling device is retrievable.

In terms of the drilling device the object according to the invention and according to a second solution is furthermore achieved in that the hollow body is a housing (machine tube) of the drilling device, and that the bracing member by way of at least one element on the internal wall of the housing provides a form-fitting connection between the main body and the housing.

A releasable yet stable and particularly precise connection between the main body and the housing can be achieved in a simple manner as a result.

It is advantageous here that the main body is removable from the housing. As a result, it is possible for the housing to be left behind in the ground separately from the main body of the drilling device, should this be necessary.

A further teaching of the invention provides that at least one clamping element having at least one movable clamping face for providing the form-fit with the at least one element is provided on at least one of the bracing elements, and that the at least one clamping face by at least one drive is able to be moved from a first position to a second position. It has been demonstrated that the form-fit can be provided in a particularly simple manner as a result.

It is advantageous here that the clamping face is provided so as to be substantially vertical or horizontal. If the clamping face is provided so as to be horizontal, it is possible for the form-fitting connection between the main body of the drilling device and the riser/housing to be achieved in a simple and effective manner in and counter to the drilling direction. If the clamping face is provided so as to be vertical, it is possible for the form-fitting connection between the main body of the drilling device and the riser/housing to be achieved in a simple and effective manner in the circumferential direction of the riser/housing.

It is furthermore advantageous that the at least one element is at least one counter bearing face for the form-fit by the at least one clamping element. As a result, the clamping elements can be disposed in a particularly simple manner so as to in each case act in the required direction. It is furthermore advantageous here that the at least one counter bearing face is provided so as to extend perpendicularly from the internal wall. As a result, the required counter bearings for the clamping elements for the form-fit can be provided in a simple manner.

A further teaching of the invention provides that, by way of the at least one clamping face and the at least one drive, a clamping force for providing the form-fit is able to be applied to the at least one element, said force being substantially orthogonal to the drilling direction or counter to the drilling direction.

A further teaching of the invention provides that at least two clamping elements that are provided so as to be substantially vertical and aligned in an opposing manner are in each case provided so as to have at least one clamping face that is disposed so as to be substantially vertical. Particularly accurate positioning can be achieved in a simple and efficient manner as a result. Furthermore, the form-fitting connection is provided in a simple manner.

It is advantageous here that the at least two clamping elements by means of at least one drive are in each case able to be moved horizontally from the first position to the second position.

A further teaching of the invention provides that the at least one drive is at least one hydraulic cylinder.

A further teaching of the invention provides that at least two bracing planes having in each case at least two bracing elements are provided so as to be disposed on top of one another. The form-fitting connection is provided particularly efficiently and reliably in a simple manner as a result.

It is advantageous here that the at least one clamping element by way of the at least one substantially vertical clamping face is disposed on at least one bracing element of the lower bracing plane.

A further teaching of the invention provides that the bracing member is in contact with the internal wall of the hollow body or housing.

A further teaching of the invention provides that the drill head by means of at least one drive is repositionable in relation to the drive in and counter to the drilling direction.

It is advantageous here that the drive is at least one hydraulic cylinder, and that the contact pressure force of the drill head on the ground is able to be determined by way of the hydraulic cylinder. As a result, a load control on the drill head can be provided in a simple manner.

A further teaching of the invention provides that the drill hole is a substantially vertical drill hole.

A further teaching of the invention provides that the drill hole is established in water or by a bore hole filled with a liquid.

The object according to the invention is furthermore achieved by a system for establishing a drill hole in the ground, having a drilling device described above and a hollow body.

The hollow body is preferably a pile for founding a building, a casing, a liner or a housing (machine tube) of the drilling device.

It is furthermore advantageous here that the hollow body on the internal wall thereof has at least one element for establishing a form-fitting connection between the main body and the hollow body.

The at least one element preferably has a counter bearing face.

The counter bearing face is particularly preferably provided so as to extend perpendicularly from the internal wall of the hollow body.

The invention will be explained in more detail hereunder by means of a preferred exemplary embodiment in conjunction with a drawing in which.

Figure 1:
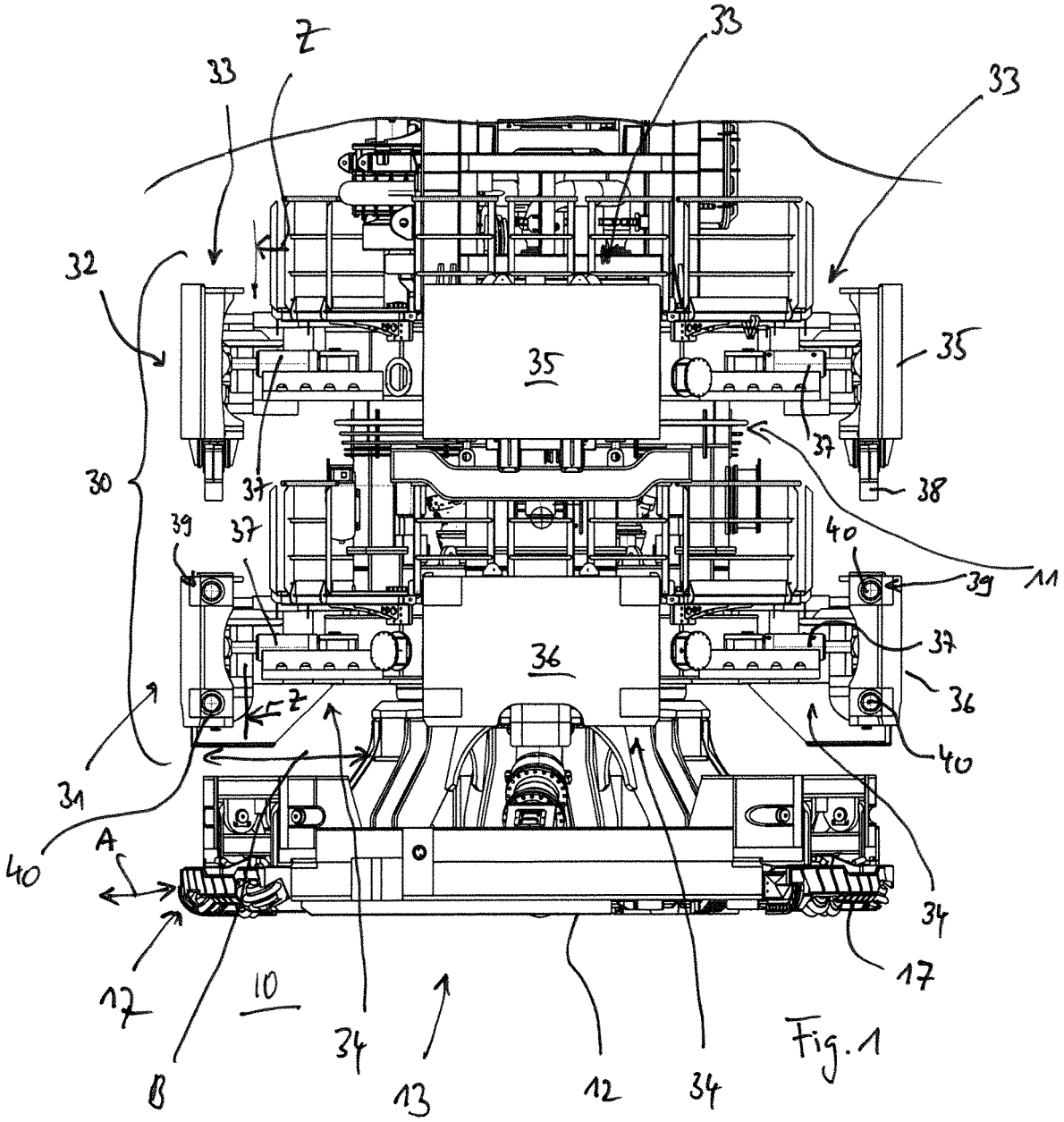
FIG. 1 shows a spatial lateral view of a drilling device according to the invention having a deployed bracing device.
Figure 2:
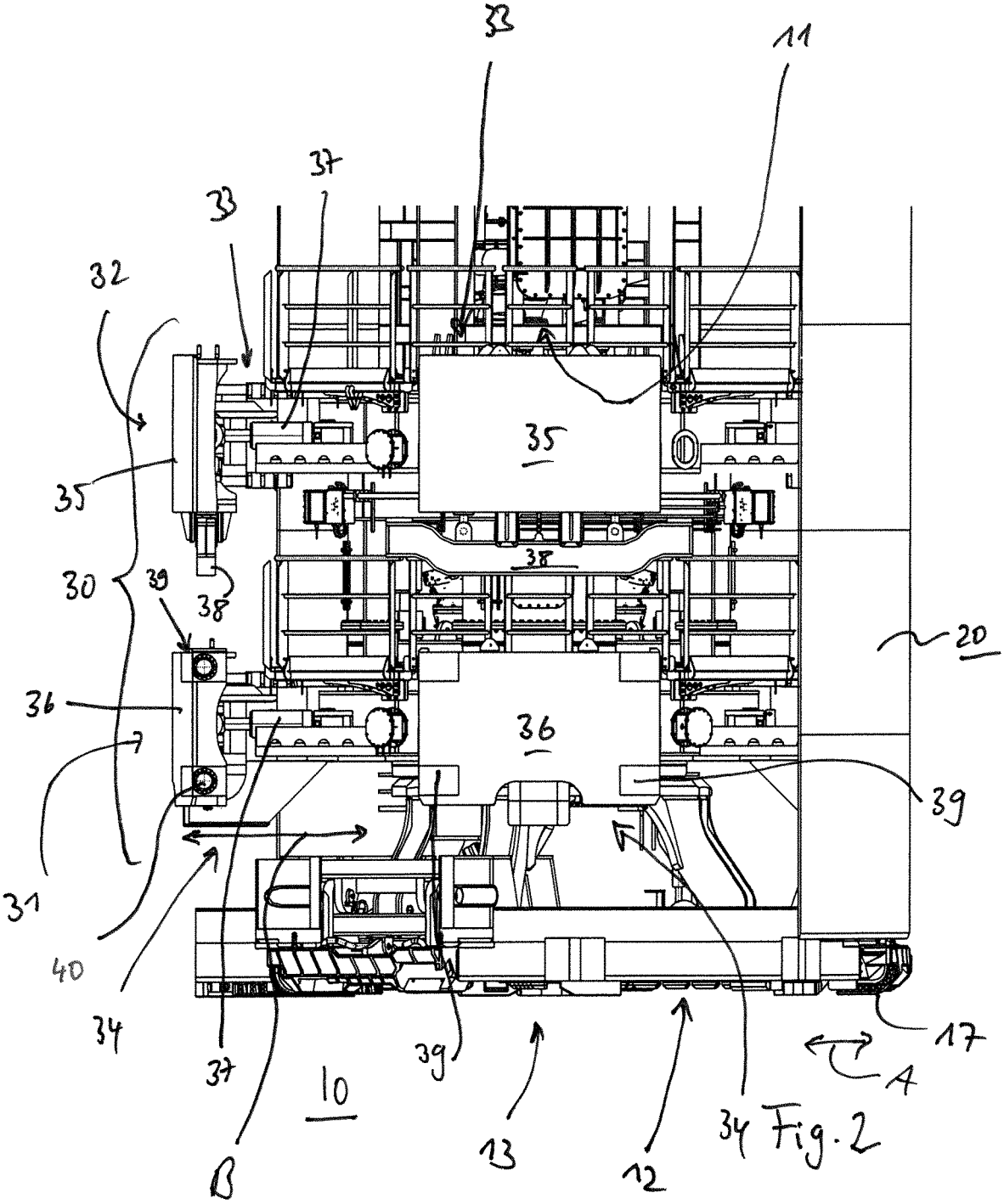
FIG. 2 shows a spatial lateral view of a drilling device according to the invention disposed in a riser/housing, in a partially sectional view.

FIG. 1 and FIG. 2 show a drilling device 10 having a main body 11. This drilling device 10 in FIG. 2 is illustrated in a partially sectional view and inserted in a riser/housing 20.

Figure 7:
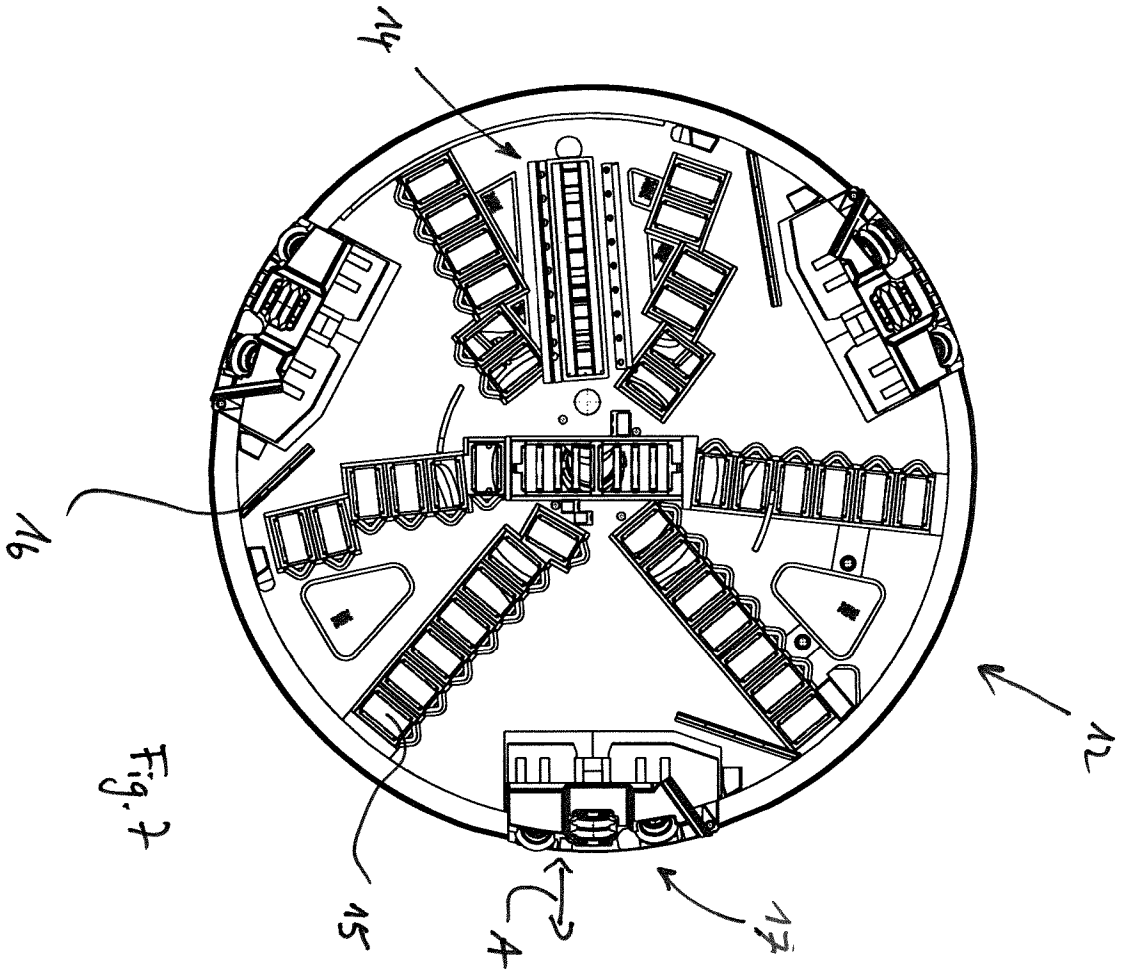
FIG. 7 shows a spatial view of a drilling tool of the drilling device according to the invention.

Provided on the lower end 13 of the main body 11 is a drill head 12 which is connected to a drive (not illustrated). Furthermore provided on the drill head 12 is a suction opening 14 (see FIG. 7) which is connected to a suction line (not illustrated) which is connected to the main body and to a suction device (not illustrated). Furthermore provided on the drill head are drilling tools 15 and guide plates 16. Furthermore provided are drilling tools 17 which are radially deployable and retractable in the direction of the arrow A and by way of which an undercut below the riser/housing 20 is achieved, as is illustrated in FIG. 2.

The main body 11 has a bracing device 30 by way of which the drilling device 10 is braced in the riser/housing 20. The bracing device 30 here has at least one bracing plane 31, 32. A preferred embodiment in which the bracing device 30 has two bracing planes 31, 32, i.e. the lower bracing plane 31 and the upper bracing plane 32, is illustrated in FIGS. 1 to 7. The upper bracing plane 32 here preferably has four bracing elements 33, and the lower bracing plane 31 here preferably has four bracing elements 34. Alternative numbers of bracing elements 33, 34 as well as bracing planes 31, 32 are likewise possible, depending on the length of the drilling device 10 or the riser/housing 20 or the geological conditions.

The bracing elements 33, 34 are fixedly disposed on the main body 11. Pivotable solutions are likewise possible.

Bracing members 35, 36 are provided on the outer end of the bracing elements 33, 34. These bracing members 35, 36, by way of in each case one drive 37, here preferably in each case one hydraulic cylinder, are disposed so as to be movable, i.e. deployable and retractable in the direction of the arrow B. The bracing members 35, 36 in FIGS. 1, 2 are illustrated when deployed.

The bracing members 35, 36 are in each case provided with clamping elements 38, 39. The clamping elements 38, 39 here have clamping faces 40, 41 which by way of at least one drive 42, 43, preferably a hydraulic cylinder, are able to be moved from a first position to a second position.

Figure 4:
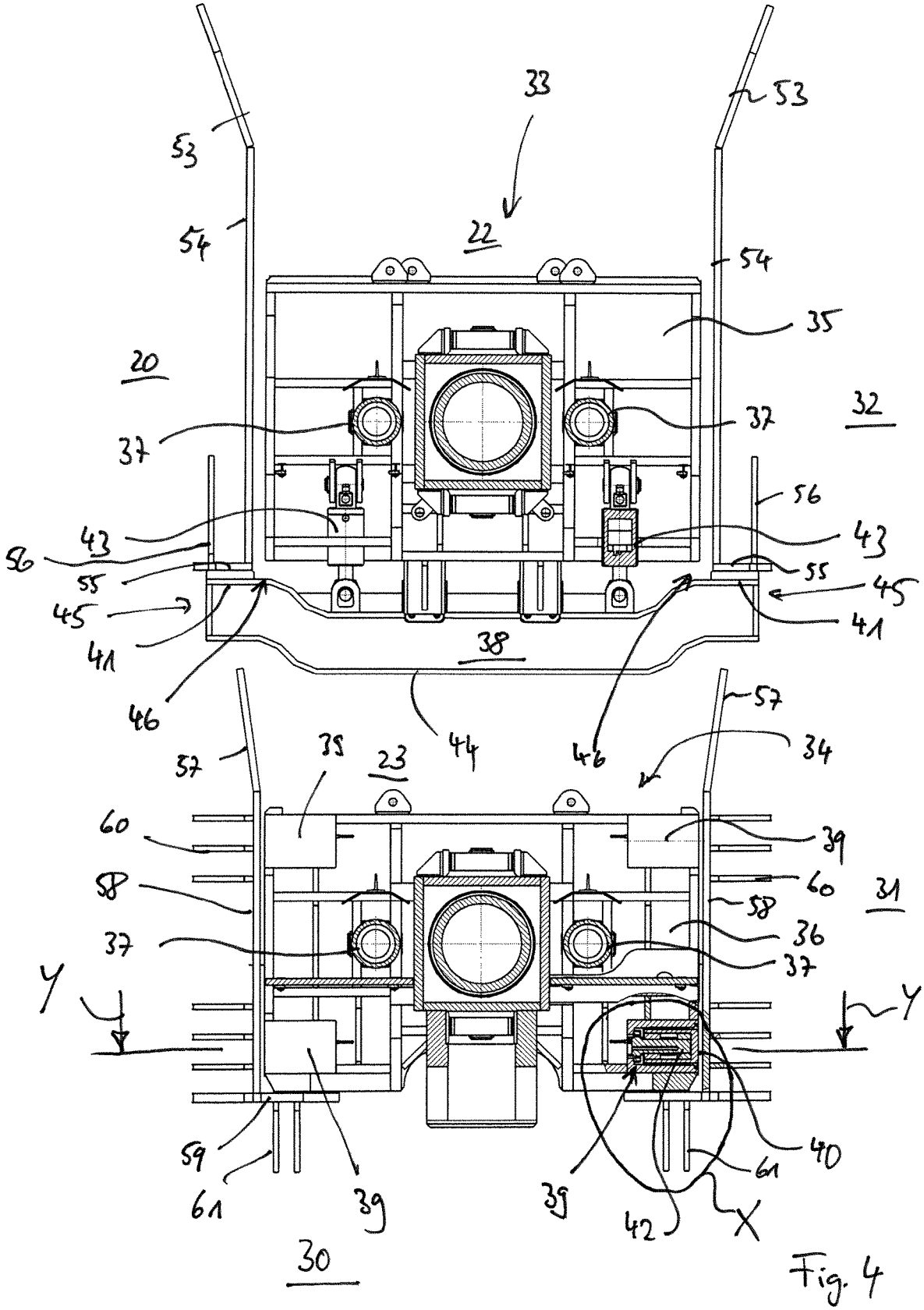
FIG. 4 shows a lateral view of FIG. 3, having an assembled bracing device according to the invention, viewed according to the section plane Z in FIG. 1.
Figure 5:
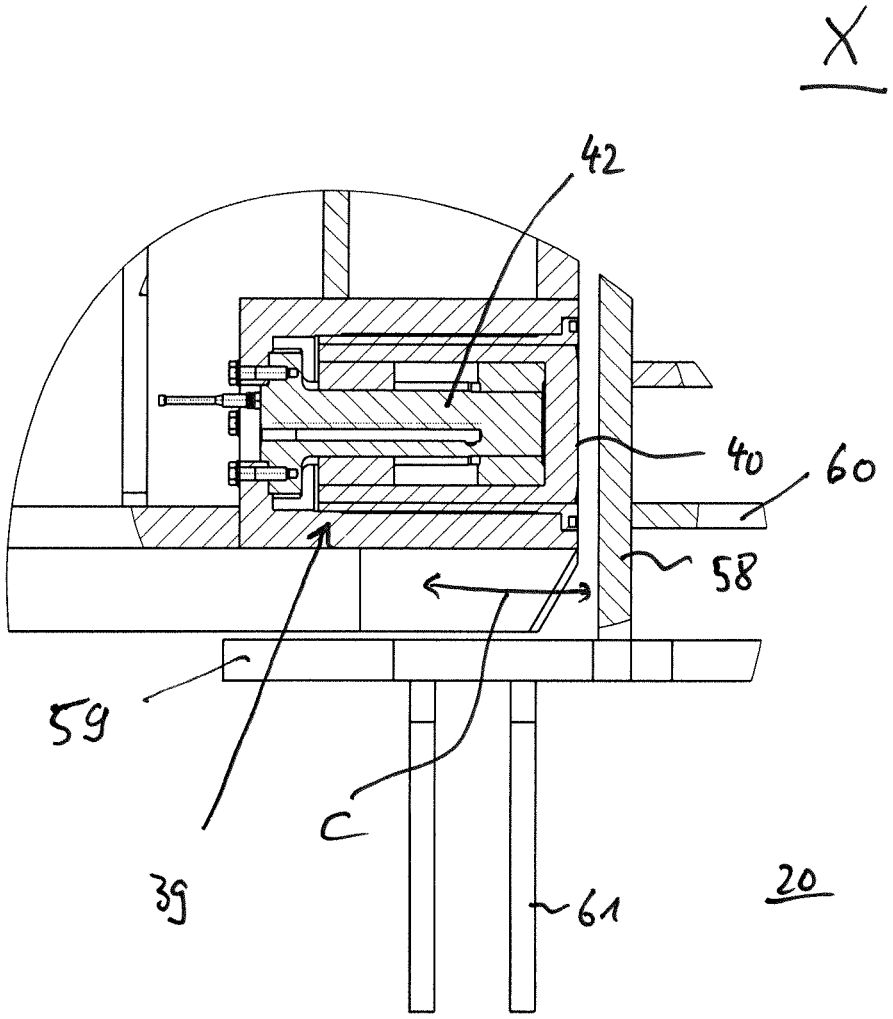
FIG. 5 shows an enlarged view of a fragment X of FIG. 4.
Figure 6:
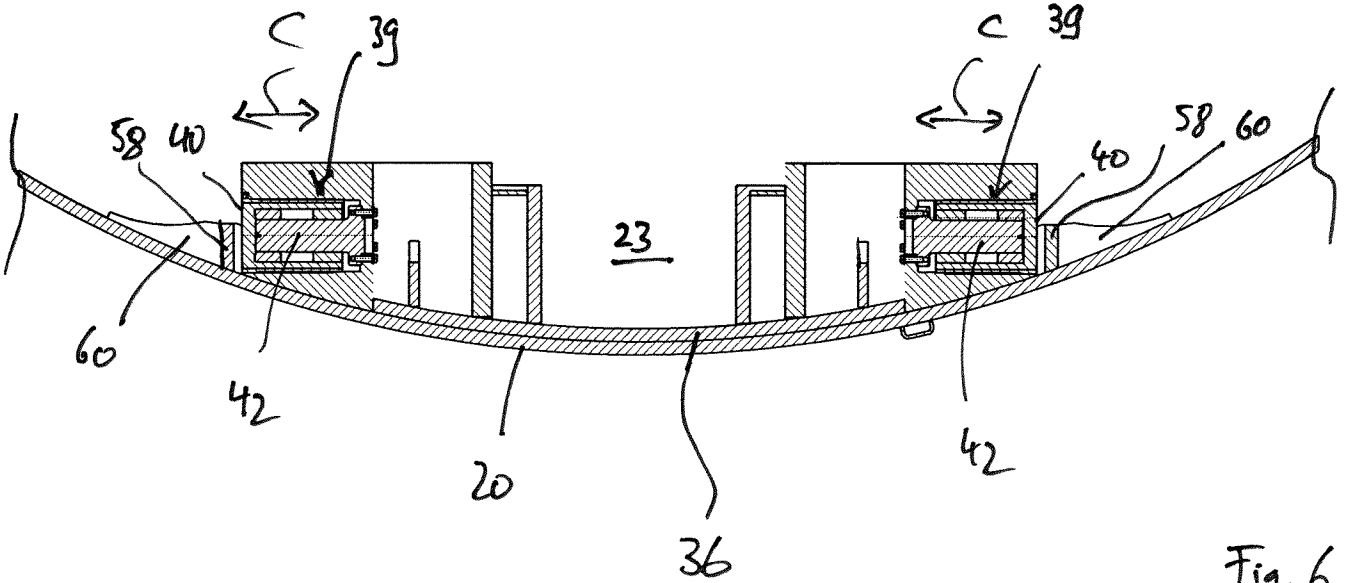
FIG. 6 shows a sectional plan view of the section Y of FIG. 4.

The lower bracing plane 31 having the bracing members 36 here preferably has in each case four clamping elements 39 per bracing member 36, said clamping elements 39 having in each case one clamping face 40 which, by way of a hydraulic cylinder as the drive 42, are disposed so as to be deployable and retractable in the direction of the arrow C in relation to the bracing member 36 (see FIGS. 4, 5, 6). The clamping elements 39 here are provided so as to be horizontal, and the clamping faces 40 are disposed so as to be vertical. The bracing members 36 here furthermore preferably have four horizontal clamping elements 39, of which two are in each case preferably aligned in one direction, the other two being aligned in the opposite direction. The direction of action of the clamping element 40 is provided so as to be in the circumferential direction about the riser/housing 20. The drilling loads, in particular the torques, can be dissipated as a result. Furthermore, it becomes possible for the form-fitting connection between the main body 11 of the drilling device 10 and the riser/housing 20 to be achieved in a simple manner so as to be effective in the circumferential direction of the riser/housing.

The upper bracing plane 32 having the bracing members 35 here preferably has in each case one clamping element 38 per bracing member 35, said clamping element 38 having a crossbar 44 which by way of a drive 43, here preferably in each case two hydraulic cylinders, is connected to the bracing member 35 on the lower side of the bracing member 35. The crossbeam 44 on the outer ends 47 thereof has in each case one clamping face 41 which is provided on that side 46 of the crossbeam 44 that faces the clamping member 35. The crossbeam by way of the drive 43 is able to be moved in the direction of the arrow D away from the bracing member and toward the latter (see FIG. 4). The clamping faces 41 here are preferably disposed so as to be horizontal, while the movement of the clamping faces 41 here, by way of the drives 43, preferably takes place vertically. The direction of action of the clamping element 41 is however provided in the drilling direction. As a result, the drilling loads can be dissipated. Furthermore, it becomes possible for the form-fitting connection between the main body 11 of the drilling device 10 and the riser/housing 20 to be achieved in a simple manner so as to be effective in and counter to the drilling direction.

Figure 3:
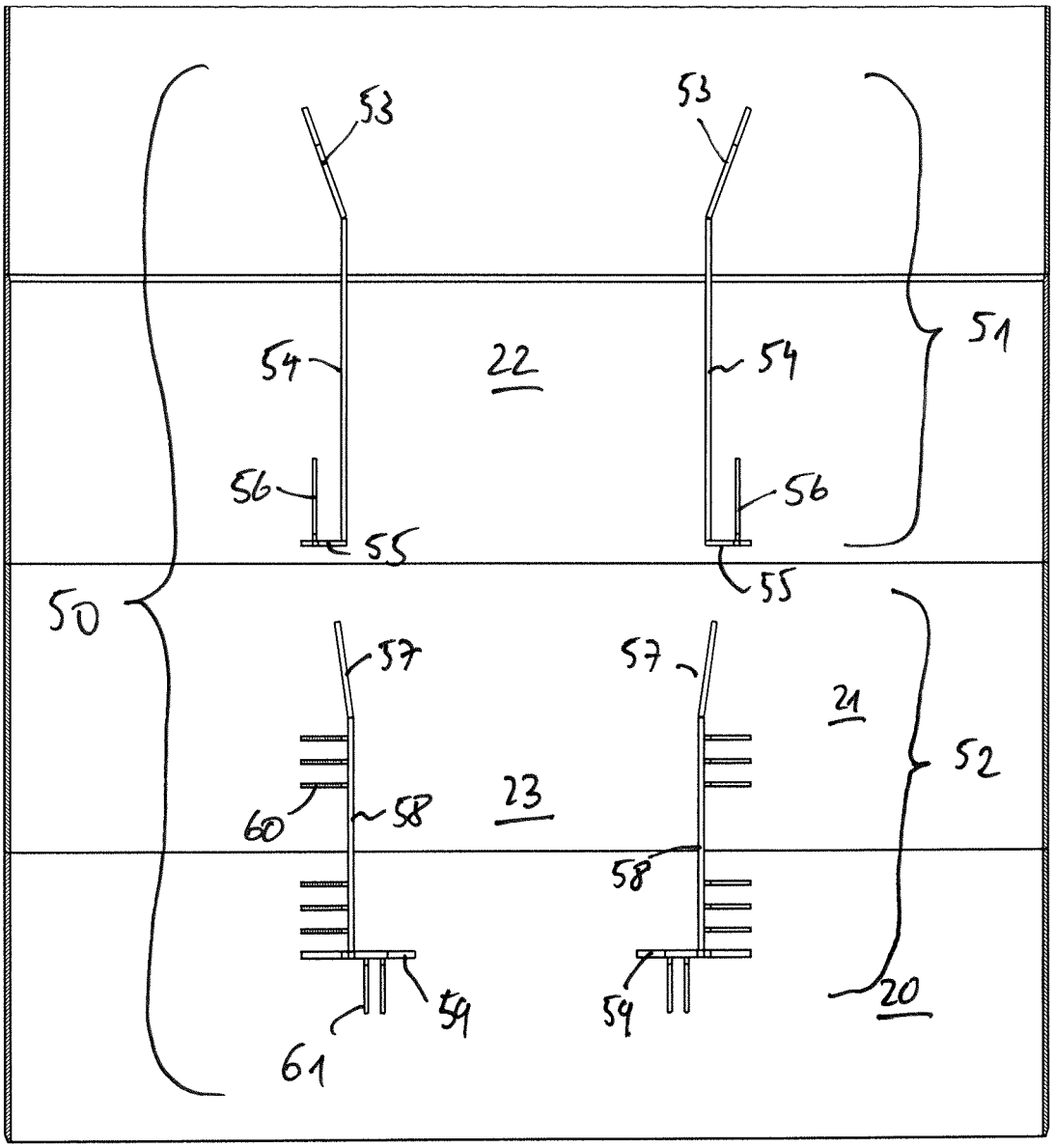
FIG. 3 shows a lateral view of counter bearing elements according to the invention on the internal wall of the riser/housing.

The internal wall 21 of the riser/housing 20 has a counter bearing region 50 which here preferably has an upper counter bearing plane 51 and a lower counter bearing plane 52. The latter is illustrated in FIGS. 3 and 4.

The upper counter bearing plane 51 has vertical guide plates 54, introduction ramps 53 being provided on the upper end of said vertical guide plates 54. Horizontal counter bearings 55 which are provided so as to be orthogonal to the guide plates 54 are provided on the lower end of the guide plates 54. The counter bearings 55 are provided with reinforcements 56 which are embodied in the manner of cams, for example. The horizontal counter bearings 55 are embodied in a manner corresponding to that of the clamping faces 41. The clamping faces are braced in relation to the counter bearings 55.

The lower counter bearing plane 52 has vertical counter bearings 58, introduction ramps 57 being provided on the upper end of said vertical counter bearings 58. Provided on the lower end of the counter bearings 58 are horizontal contact faces 59 which are provided so as to be orthogonal to the counter bearings 58. The counter bearings 58 and the contact faces 59 are provided with reinforcements 60, 61 which are embodied in the manner of cams, for example.

The bracing members 36 are incorporated into the intermediate space 23 between the counter bearings 58 by deploying the lower drives 37. The bracing members 35 are incorporated into the intermediate space 22 between the guide plates 54 by deploying the upper drives 37. The drives 43 of the crossbeams 44 of the clamping elements 38 here are preferably deployed such that the clamping faces 41 can be disposed below the counter bearings 55. The clamping faces 40 by way of the drives 42 thereof are preferably retracted.

Furthermore, the clamping members 35, 36 can be deployed so far that the latter contact the internal wall 21.

If necessary, it is even possible for the clamping members 35, 36 to be braced in relation to the internal wall. This however is preferably not envisaged.

The lower bracing members 36 are optionally placed onto the contact faces 59.

In order for the form-fitting connection between the riser/housing 20 and the main body 11 to be established, the clamping faces 40 are deployed horizontally against the counter bearings 58 once the clamping members 35, 36 are disposed. The clamping faces 41 are moved against the counter bearings 55. As a result, a form-fit is effected between the main body 11 and the riser/housing 20.

The drilling using the drilling device according to the invention takes place once the main body of the drilling device 10 has been inserted into the riser/into the housing 20 and the riser/the housing 20 has been transferred to the drilling position. The drilling can be carried out from horizontally up to vertically. This is performed either by a feeder unit or by the weight of the drilling device 10 together with the riser/housing 20.

Once the drilling is completed, either the form-fitting connection is released in the reversed order as previously described, and the main body 11 is retrieved from the riser/housing 20 once the deployed drilling tools 17 have been retracted in the direction of the arrow A, or the housing conjointly with the main body 11 is retrieved from the bore hole (not illustrated) and left to stand open.

It is possible for different riser/housing diameters to be used conjointly with a main body 11 and the apparatuses provided thereon, and also for different matching drill head diameters to be used to this end.

LIST OF REFERENCE SIGNS

10 Drilling device
11 Main body
12 Drill head
13 Lower end
14 Suction opening
15 Drilling tool
15 Guide plate
17 Drilling tool
20 Riser/housing
21 Internal wall
22 Intermediate space
23 Intermediate space
30 Bracing device
31 Bracing plane
32 Bracing plane
33 Bracing element
34 Bracing element
35 Bracing member
36 Bracing member
37 Drive/hydraulic cylinder
38 Clamping element
39 Clamping element
40 Clamping face
41 Clamping face
42 Drive/hydraulic cylinder
43 Drive/hydraulic cylinder
44 Crossbar
45 End
46 Side
50 Counter bearing region
51 Upper counter bearing plane
52 Lower counter bearing plane
53 Introduction ramp
54 Guide plate
55 Counter bearing
56 Reinforcement
57 Introduction ramp
58 Counter bearing
59 Contact face
60 Reinforcement
61 Reinforcement
A Direction of arrow
B Direction of arrow C Direction of arrow
D Direction of arrow
X Fragment
Y Section plane
Z Section plane

The invention claimed is:

1. A drilling device for establishing a drill hole in the ground, having a main body; comprising;

a drilling tool which is disposed on one end of the main body;

a first drive for the drilling tool that is provided on the main body;

a bracing device which is configured to brace the drilling device in a cylindrical hollow body, the hollow body comprising an internal wall with at least one counter bearing element;

the bracing device comprising at least one bracing plane comprising at least two bracing elements with a first end disposed on the main body and on the second end at least one bracing member;

wherein the at least one bracing member of the at least two bracing elements is configured to, by at least one second drive, be moved horizontally from a first position to a second position to be in contact with the internal wall of the hollow body at the second position;

wherein;

the at least one bracing element comprises at least one moveable clamping element with at least one clamping surface;

the at least one clamping element is configured such that the at least one clamping surface is moveable against the at least one counter bearing element, by at least one third drive, one of vertically counter to a drilling direction of the drilling device or horizontally counter to or in a rotation direction of the drilling tool to be in contact with the at least one counter bearing element on the internal wall of the hollow body, wherein the at least one counter bearing element provides forces to the drilling device counter to the drilling direction or drill rotation direction; and wherein the at least one counter bearing element comprises least one counter bearing face for providing a form fit by the at least one clamping element.

2. The drilling device as claimed in claim 1, wherein the hollow body is a pile for founding structures, including a building, a casing, or a liner.

3. The drilling device as claimed in claim 1, wherein the main body is removable from the hollow body.

4. The drilling device as claimed in claim 1, wherein the hollow body is a housing of the drilling device.

5. The drilling device as claimed in claim 4, wherein the main body is removable from the housing.

6. The drilling device as claimed in claim 1, wherein the clamping surface is one of vertical or horizontal.

7. The drilling device as claimed in claim 1, wherein the at least one counter bearing face extends perpendicularly from the internal wall.

8. The drilling device as claimed in claim 1, wherein the at least one third drive is at least one hydraulic cylinder.

9. The drilling device as claimed in claim 1, wherein at least two bracing planes of said at least one bracing plane comprise the at least two bracing elements disposed on top of one another.

10. The drilling device as claimed in claim 9, wherein the at least one clamping element by way of at least one vertical clamping surface is disposed on at least one of the at least two bracing elements of a lower bracing plane.

11. The drilling device as claimed in claim 1, wherein the drilling tool is configured to, by means of at least one fourth drive, be repositionable in relation to a drive in, and counter to, the drilling direction.

12. The drilling device as claimed in claim 11, wherein the at least one fourth drive is at least one hydraulic cylinder, and wherein a contact pressure force of the drilling tool on the ground is determined by the at least one hydraulic cylinder.

13. The drilling device as claimed in claim 1, wherein the drill hole is a vertical drill hole.

14. The drilling device as claimed in claim 1, wherein the drill hole is one of in water or a bore hole filled with a liquid.

* * * * *